United States Patent [19]

Nathan

[11] 4,156,446

[45] May 29, 1979

[54] TOTE BAG

[76] Inventor: Ludwig Nathan, 155 E. 34th St., New York, N.Y. 10016

[21] Appl. No.: 940,227

[22] Filed: Sep. 7, 1978

[51] Int. Cl.[2] ..... A45C 3/10

[52] U.S. Cl. ..... 150/11; 150/1

[58] Field of Search ..... 150/11, 50, 1.7, 34, 150/33, 42, 1, 30

[56] References Cited

U.S. PATENT DOCUMENTS

| | | | |
|---|---|---|---|
| 1,148,924 | 8/1915 | Paradise | 150/11 |
| 1,681,922 | 8/1928 | Boch | 150/11 |
| 2,447,940 | 8/1948 | Holland | 150/11 X |
| 2,500,341 | 3/1950 | Burnett | 150/11 X |
| 2,713,370 | 7/1955 | Quinn | 150/11 |

*Primary Examiner*—Donald F. Norton

*Attorney, Agent, or Firm*—Eric P. Schellin

[57] ABSTRACT

There is disclosed a tote bag that has a mouth that may be shirred closed by a cord. The bag has a main body portion that has flexible sides. Along the sides thereof are a plurality of pockets that result from the attachment of a web that is secured at the bottom edge thereof to the bottom portion of the bag. Additionally, the web is secured at its upper edge portion to the main body portion to thereby provide a plurality of pockets. The bottom of the bag consists of a perforated panel. At the same time the pockets are provided with relatively small openings to provide drainage of the pockets when necessary. The bag finds utility as an essentially waterproof and mildew proof bag for skin divers, snorklers and scuba divers equipment and for underwater collecting purposes.

10 Claims, 4 Drawing Figures

TOTE BAG

FIELD OF THE INVENTION

The present invention relates generally to a fairly large tote bag useful for carrying items and other paraphenalia normally carried by individuals who engage in snorkeling activities. The tote bag is adapted and constructed to carry on the outside of the main body portion at least two pairs of swim fins. Internally of the bag there may be positioned face masks, gloves and snorkel tubes and the like. The bag is useful as indicated and possesses sturdy qualitites that will make it long lasting.

BACKGROUND OF THE INVENTION

In carrying the equipment necessary for snorkeling, one finds that there are a number of pieces most of a fairly small size but all having unusual configurations. The physical characteristics and the configuration of these items make it quite difficult to easily and conveniently carry the items. Various bags and cases have been used, but thus far none have been specifically designed to carry these items in a convenient and non-interfering manner.

SUMMARY OF THE INVENTION

Briefly, the invention comprises a bag constructed of two flexible panels that are sewn together at the vertical edges. The bag is given a polygonal or squared configuration by a perforated more rigid bottom. The panels may be fabricated of a woven textile material. The end opposite the perforated bottom is the mouth of the bag. The bag is closed by means of a shirring, i.e., by a cord that is passed alternately through a series of grommeted holes near the top portion of the panels. The bag is also provided with a series of upwardly facing open pockets into which fins are placed. The fins are also supported or retained in the pockets by looping portions of the shirring cord over the heel portion of the fins. Of interest is the fact that the bottom of the pockets are provided with drain openings so that the fins may be lodged in the pockets in a wet condition.

DETAILED DESCRIPTION OF THE EMBODIMENT OF THE PRESENT INVENTION

Figure 1:
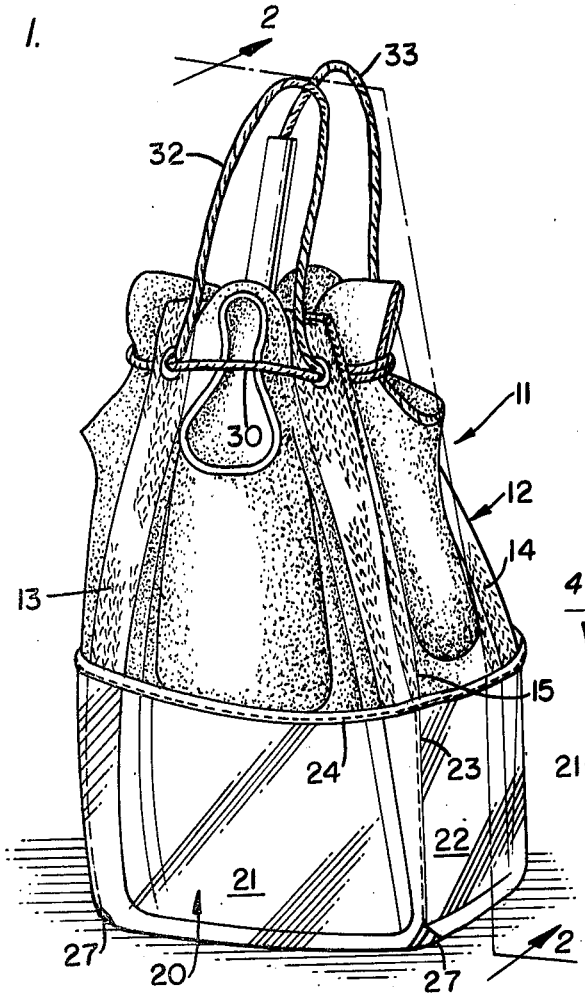
FIG. 1 is a perspective of the bag of the present invention.

The tote bag, referred to generally by reference numeral 11 has the appearance of having four sides. However, it should be noted that the main body portion 12 consists of two panels 13 and 14. The two panels are sewn together in a conventional manner along two vertical seams 15 to form one corner as can be readily observed from FIG. 1. The other seam 15 cannot be seen in FIG. 1, due to the fact that it is located at the diammetrically opposite corner.

For increased strength purposes the upper portion 16 is folded over on itself and sewn to produce a large conventional hem. For greater rigidity and strength a wide ribbon of a stiffening material is sandwiched between the folded over portion. This upper portion is fitted with spaced pairs of conventional grommets 17 in suitably positioned openings. It has been found most efficaious in carrying out the precepts of the invention to provide eight pairs of metal grommets at substantially the same horizontal level so that each grommet of a pair is spaced from each other at less of a distance than each pair is spaced from another pair. The total number of grommets therefore will be sixteen. The usefullness afforded by the positioning and spacing of the grommets in the fashion indicated will be explained hereinafter.

The material of construction of the main body portion may be of almost any woven material, non-woven material or of a plastic film material. However, it has been found that a woven material manufactured from synthetic fibers such as nylon or a polyester material provides excellent desirable flexibility. Such material has the ability to be essentially non-water absorbing so that it will dry rapidly and will also be mildew proof. The inside facing portion of the material may have a coating to fill the interstices of the woven material when such material is employed. The grommets while stated in the above to be constructed of metal may also be constructed of a thermoplastic or, preferably, of a thermosetting material.

Figure 2:
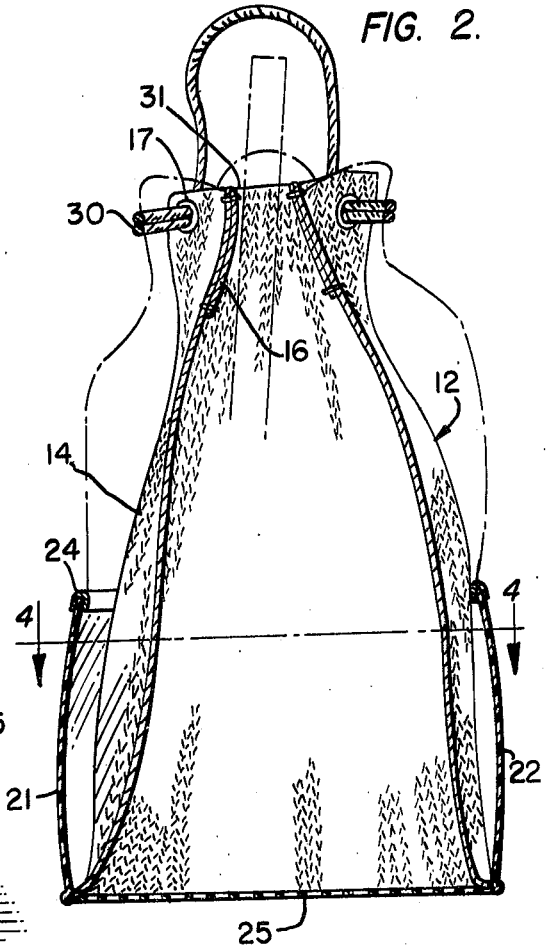
FIG. 2 is a cross-sectional view taken along line 2—2 of FIG. 1.
Figure 3:
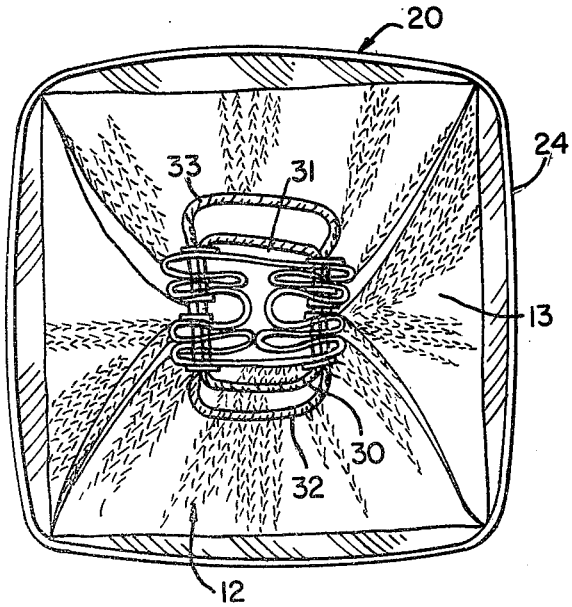
FIG. 3 is a top plan view of the bag of the present invention.
Figure 4:
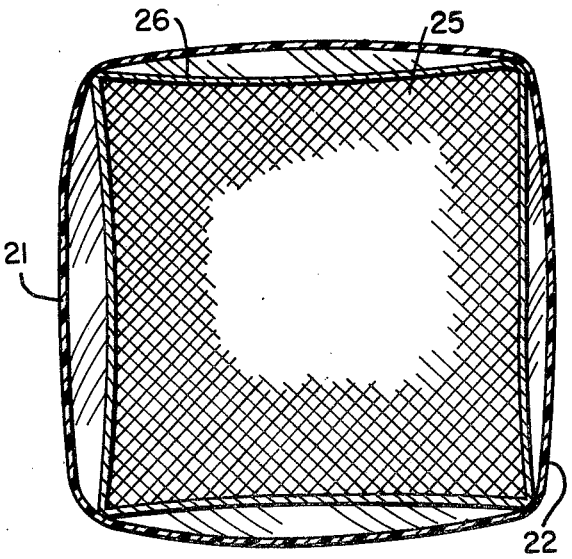
FIG. 4 is a bottom view of the bag of the present invention.

Externally of the main body portion 12 is a transparent band 20 of fairly large dimensions as can be seen from FIGS. 1 and 2. The band 20 is also constructed of two panels 21 and 22 of a transparent film. One vertical edge of panel 21 and one vertical edge of panel 22 are brought together and are incorporated as a part of seam 15 as mentioned in the above so that a multipart seam 23 is achieved. Likewise is accomplished at the other vertical ends of panels 21 and 22 so that these also become a part of the seam not visible as stated before.

The transparent panels 21 and 22 are supplied with horizontal edge piping 24 to protect the upwardly facing edges of the panels 21 and 22. The piping consists of an elongated narrow strip of a plastic material which is applied to the edge of the pieces by folding over to sandwich the edge of the panels therebetween and is sewn in place as can be seen from FIGS. 1 and 2. Other suitable adhering means may be employed such as adhesive or heat welding.

The bottom 25 consists of a plastic mesh that has an essentially square configuration. The edges of the bottom terminate in a rounded piping 26 which has an outwardly extending flange. The piping 26 is adhesively secured to the mesh portion as by suitable adhesives or by heat welding. The said outwardly extending flange is brought together with the horizontal bottom edges of the main body portion 12 and the lower edges of panels 21 and 22. The thereby produced sandwich is sewn together in a conventional manner to incorporate all three elements.

However, the edges of panels 21 and 22 have positions 27 cut out opposite the corners of the bottom 25 whereby several advantages are obtained; of course, one being that the sewing step is accomplished somewhat easier as a bunching up of material at the corners is avoided. Another advantage resides in the fact the bottom of the two pockets formed by panels 21 and 22 and the main body portion of the bag possess openings through which sand and water may drain to thereby avoid accumulation of such materials in the pockets.

The mesh bottom, of course, insures similar drainage of liquid and particulate material from the main body portion of the bag.

The upper portion of the bag of the present invention is supplied with a double length of stout cord 30 which may be of nylon, polyester, or polypropylene and the like. The cord is in length approximately twice the circumference of the bag when it is in its most open configuration. The two ends are suitably knotted together. The cord 30 is used to close the mouth 31 of the bag by shirring it in a conventional manner as depicted in the figures. By pulling forcefully upwardly on two upper portions of the cord located directly oppositely as shown in the figures upwardly extending loops 32 and 33 are provided which act as handles to tote the bag at, say arm's length.

The aforementioned pockets produced by the panels 21 and 22 of transparent material are adapted and constructed to accept the toe and primarily the web portion of one or two pairs of swim assist fins as shown in the figures. The upwardly extending heel portion is secured in place by having the lower level cord 30A positioned as shown in the figures to encompass the heel of each fin positioned in the pockets numbering four in number, as shown. By dimensioning the bag of the present invention at a height that is approximately the height of the fin the bag is adapted to accomplish the role designed for it quite satisfactorily.

While the pockets of the bag are designed for the fins, the inside of the main body portion of the bag of the present invention may contain the other paraphenalia commonly used on a beach or additional equipment useful for diving or snorkeling. It will be noted that in FIG. 1 and FIG. 2 the elongated part of a snorkel protrudes from the mouth of the bag. The bag of the present invention may be also employed by a scuba diver to harvest desirable items while underwater. The bag may be easily draged by the cord. The perforated bottom permits water flow therethrough so that there is little water resistance.

The perforated bottom is also useful in that items which are to be cleansed may be positioned therein. Thereafter the bag and its contents may be dunked in water several times to flush water therethrough or the bag may be placed under a spigot of running water to permit the water to wash over the contents and flush through the perforations of the bottom of the bag.

While the preferred embodiment of the present invention has been described in specific detail, it should be understood that numerous modifications, additions and omissions in the details thereof are possible within the intended spirit and scope of the invenion claimed herein.

What is claimed is:

1. A bag comprising:

a. a main body portion having flexible sides with upper and lower edges and a bottom, b. said upper edge providing an upwardly facing mouth, c. a plurality of apertures spaced along a horizontal plane of the sides of said main body portion proximate said mouth, d. said apertures having an elongated flexible means strung therethrough whereby said mouth may be shirred into a closed position, e. said main body portion having an encompassing web means positioned around the lower portion of said main body portion and having an upper edge and a lower edge, f. said web means being attached to said main body substantially along its lower edge to the lower edges of said sides, g. said web also being attached at spaced intervals along its upper edge to provide attachments to said main body portion whereby pockets are formed having upwardly facing openings.

2. The bag of claim 1 wherein the bottom has a rectangular configuration whereby the main body portion defines a bag having corners.

3. The bag of claim 1 wherein the bottom is perforated.

4. The bag of claim 2 wherein the attachments are at said corners.

5. The bag of claim 4 wherein the web has an unattached lower edge portion at said corners whereby said pockets having openings at their bottoms.

6. The bag of claim 5 wherein the bottom is perforated.

7. The bag of claim 6 wherein the flexible sides are constructed from two separate panels which are attached to one another along two vertical seams at the said corners.

8. The bag of claim 7 wherein the said encompassing web is constructed of two separate panels which are attached to one another concurrently with the seams of the two separate panels of the flexible sides.

9. The bag of claim 8 wherein the elongated flexible means strung through said apertures includes at least a double elongated flexible means.

10. The bag of claim 9 wherein the apertures are strengthened with grommets.

* * * * *